US008420010B2

(12) United States Patent
Nakamura et al.

(10) Patent No.: US 8,420,010 B2
(45) **Date of Patent: *Apr. 16, 2013**

(54) METHOD FOR PREPARING RARE EARTH PERMANENT MAGNET MATERIAL

(75) Inventors: Hajime Nakamura, Echizen (JP); Takehisa Minowa, Echizen (JP); Koichi Hirota, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 987 days.

This patent is subject to a terminal disclaimer.

(21) Appl. No.: 11/916,498

(22) PCT Filed: Mar. 28, 2007

(86) PCT No.: PCT/JP2007/056586

§ 371 (c)(1),
(2), (4) Date: Dec. 4, 2007

(87) PCT Pub. No.: WO2007/119551

PCT Pub. Date: Oct. 25, 2007

(65) Prior Publication Data

US 2009/0226339 A1 Sep. 10, 2009

(30) Foreign Application Priority Data

Apr. 14, 2006 (JP) ..... 2006-112358

(51) Int. Cl.
*B22F 7/00* (2006.01)

(52) U.S. Cl.
USPC ..... 419/9; 148/101

(58) Field of Classification Search ..... 148/302, 148/101; 419/9
See application file for complete search history.

(56) References Cited

U.S. PATENT DOCUMENTS

| | | | | |
|---|---|---|---|---|
| 5,034,146 | A | 7/1991 | Ohashi et al. | |
| 6,606,019 | B1 | 8/2003 | Ohashi | |
| 6,709,533 | B2 | 3/2004 | Honkura et al. | |
| 6,960,240 | B2 | 11/2005 | Hirota et al. | |
| 7,402,226 | B2 | 7/2008 | Machida et al. | |
| 7,559,996 | B2 * | 7/2009 | Miyata et al. | 148/302 |
| 2006/0213582 | A1 | 9/2006 | Nakamura et al. | |
| 2006/0213583 | A1 | 9/2006 | Nakamura et al. | |
| 2006/0213584 | A1 | 9/2006 | Nakamura et al. | |
| 2006/0213585 | A1 | 9/2006 | Nakamura et al. | |
| 2007/0017601 | A1 | 1/2007 | Miyata et al. | |
| 2007/0034299 | A1 | 2/2007 | Machida et al. | |
| 2007/0160863 | A1 | 7/2007 | Hamada et al. | |
| 2007/0240788 | A1 | 10/2007 | Nakamura et al. | |
| 2007/0240789 | A1 | 10/2007 | Nakamura et al. | |
| 2008/0054736 | A1 | 3/2008 | Miyata et al. | |
| 2008/0223489 | A1 | 9/2008 | Nagata et al. | |
| 2008/0245442 | A1 | 10/2008 | Nakamura et al. | |
| 2008/0247898 | A1 | 10/2008 | Nakamura et al. | |
| 2009/0098006 | A1 | 4/2009 | Nakamura et al. | |
| 2009/0226339 | A1 | 9/2009 | Nakamura et al. | |

FOREIGN PATENT DOCUMENTS

| | | | | |
|---|---|---|---|---|
| EP | 1734539 | A1 | | 12/2006 |
| JP | 62-192566 | A | | 8/1987 |
| JP | 62192566 | A | * | 8/1987 |
| JP | 62-256412 | A | | 11/1987 |
| JP | 1-117303 | A | | 5/1989 |
| JP | 04-184901 | A | | 7/1992 |
| JP | 5-21218 | A | | 1/1993 |
| JP | 5-31807 | B2 | | 5/1993 |
| JP | 06-158238 | A | | 6/1994 |
| JP | 6-244011 | A | | 9/1994 |
| JP | 2002-093610 | A | | 3/2002 |
| JP | 2003-282312 | A | | 10/2003 |
| JP | 3471876 | B2 | | 12/2003 |
| JP | 2004-281493 | A | | 10/2004 |
| JP | 2004-296973 | A | | 10/2004 |
| JP | 2004-304038 | A | | 10/2004 |
| JP | 2005-011973 | A | | 1/2005 |

(Continued)

OTHER PUBLICATIONS

"Nd-Fe-B Based Sintered Magnet Processed to Ultraminiature Size"; The Journal of the Institute of Electrical Engineers of Japan, vol. 124, No. 11, 2004, pp. 699-702, published Nov. 1, 2004.

(Continued)

*Primary Examiner* — Weiping Zhu
(74) *Attorney, Agent, or Firm* — Westerman, Hattori, Daniels & Adrian, LLP

(57) ABSTRACT

A method for preparing a rare earth permanent magnet material is characterized by comprising the steps of disposing a powder mixture on a surface of a sintered magnet body of $R^1$—Fe—B composition wherein $R^1$ is at least one element selected from rare earth elements inclusive of Sc and Y, the powder mixture comprising a powder containing at least 0.5% by weight of M which is at least one element selected from Al, Cu, and Zn and having an average particle size equal to or less than 300 μm and a powder containing at least 30% by weight of a fluoride of $R^2$ which is at least one element selected from rare earth elements inclusive of Sc and Y and having an average particle size equal to or less than 100 μm, and heat treating the magnet body having the powder disposed on its surface at a temperature equal to or below the sintering temperature of the magnet body in vacuum or in an inert gas, for causing at least one of M and $R^2$ in the powder mixture to be absorbed in the magnet body. The invention provides an R—Fe—B sintered magnet with high performance and a minimized amount of Tb or Dy used.

12 Claims, No Drawings

FOREIGN PATENT DOCUMENTS

| | | | |
|---|---|---|---|
| JP | 2005-285861 | A | 10/2005 |
| JP | 2006-49865 | A | 2/2006 |
| RU | 2048691 | C1 | 11/1995 |
| SU | 1513738 | A1 | 4/1995 |
| WO | 2006-003882 | A1 | 1/2006 |
| WO | 2006-43348 | A1 | 4/2006 |

OTHER PUBLICATIONS

"Shin-Etsu Chemical, develops new high-performance technology for neodymium rare-earth magnets"; Press Release (Shin-Etsu News) dated Mar. 24, 2005.
"Technology developed for enhancing heat resistance of Nd magnets"; The Nikkan Kogyo Shimbun (Mar. 25, 2005).
"Shin-Etsu Chemical develops advanced high-performance technology—High heat resistance as well as flux density of residual magnetization—Neodymuim rare-earth magnets"; The Dempa Shimbun (Mar. 25, 2005).
"Coercive force, enhanced by 30%—Neodymium magnets—by Shin-Etsu Chemical, though a new idea as to arrangement of rare-earth elements -"; The Kagaku Kogyo Shimbun (The Chemical Daily)(Mar. 25, 2005).
"Shin-Etsu Chemical, develops new advanced high-performance technology for Nd magnets—Will begin sample shipments by the end of 2005 and aim at starting mass production in 2006 -"; The Sekiyu Kagaku Shimbun Nikkan Tsushin (Mar. 25, 2005).
"Shin-Estu Chemical, develops advanced high-performance technology for neodymium rare earth magnets";The Nikkan Chemical News (Mar. 25, 2005).
"Shin-Estu Chemical, develops new high-performance technology for neodymium rare-earth magnet"; Nikkei Press Release.
H. Nakamura et al.; "Magnetic Properties of Extremely Small Nd-Fe-B Sintered Magnet"; InterMag Asia 2005; Digests of the IEEE International Magnetics Conference; p. 476; held on Apr. 4-8; 2005.
Techno-Frontier Symposium 2005; pp. B1-2-1 to B1-2-12; held on Apr. 20, 2005 by JMA.
Hajime Nakamura et al.; "Magnetic Properties of Extremely SMA;; Nd-Fe-B Sintered Magnets"; IEEE Transactions on Magnetics, vol. 41, No. 10, Oct. 2005, pp. 3844-3846.
Abstract of Autumn Meeting of Japan Society of Powder and Powder Metallurgy, 2005; "Production of Nd-Fe-B Sintered Magnet with Higher Coercive Force by Grain Boundary Diffusion" p. 143; held on Nov. 14-16, 2005.
2005 BM Symposium, Abstract of Presentation by the Japan Association of Bondet Magnet Industries, held on Dec. 2, 2005.
H. Nakamura; "Nd-Fe-B Sintered Magnets Produced by the Grain Boundary Diffusion Process"; Bulletin of Topical Symposium of the Magnetics Society of Japan, Mar. 14, 2006, pp. 13-18, Hajime Nakamura.
K. Hirota et al.; "Coercivity Enhancement by Grain Boundary Diffucion Process to Nd-Fe-B Sintered Magnets."; IEEE International Magnetics Conference, May 8-12, 2006, p. 910.
H. Nakamura et al.; "Microstructures of High Coercivity Nd-Fe-B Sintered Magnets Produced by the Grain Boundary Diffusion Process"; Digest of the 30th Annual Conference on Magnetics in Japan 2006, pp. 417-418.
K.D. Durstet al.; "The Coercive Field of Sintered and Melt-Spun NdFeB Magnets"; Journal of Magnetism and Magnetic Materials, vol. 68, (1987), pp. 63-75.
K. T. Park et al.; "Effect of Metal-Coating and Consecutive Heat Treatment on Coercivity of Thin Nd-Fe-B Sintered Magnets"; Proceedings of the Sixteenth International Workshop on Rare-Earth Magnets and Their Applications, Sendai, (2000), p. 257.
Kenichi Machida et al.; "Grain Boundary Modification and Magnetic Properties of Nd-Fe-B Sintered Magnets", Proceedings of the 2004 Spring Meeting of the Powder & Powder Metallurgy Society, p. 202.
International Search Report of PCT/JP2007/056586, date of mailing Jun. 19, 2007.
K.-D. Durst et al.; "The Coercive Field of Sintered and Melt-Spun NdFeB Magnets", Journal of Magnetism and Magnetic Materials, vol. 68, pp. 63-75, 1987.
K.T. Park et al.; "Effect of Metal-Coating and Consecutive Heat Treatment on Coercivity of Thin Nd-Fe-B Sintered Magnets", Proceedings of the Sixteenth International Workshop on Rare-Earth Magnets and Their Applications, The Japan Institute of Metals, 2000, pp. 257-264.
K. Machida et al.; "Grain Boundary Tailoring of Nd-Fe-B Sintered Magnets and Their Magnetic Properties", Proceedings of the 2004 Spring Meeting of the Powder & Powder Metallurgy Society, p. 202.
Hajime Nakamura, et al., "Microstructures of the anisotropic Nd-Fe-B HDDR treated powder," The Papers of Technical Meeting of Magnetics, Nov. 17, 1998, pp. 31-36, Technical Meeting on Magnetics, The Institute of Electrical Engineers of Japan.
Supplement European Search Report dated Mar. 22, 2010 issued in corresponding application EP 07740024.
Decision on Grant issued Oct. 27, 2010 in corresponding Russian patent application 2007141922/02(045902).

* cited by examiner

METHOD FOR PREPARING RARE EARTH PERMANENT MAGNET MATERIAL

TECHNICAL FIELD

This invention relates to a method for preparing an R—Fe—B permanent magnet so that its coercive force is enhanced while minimizing a decline of its remanence.

BACKGROUND ART

By virtue of excellent magnetic properties, Nd—Fe—B permanent magnets find an ever increasing range of application. The recent challenge to the environmental problem has expanded the application range of these magnets from household electric appliances to industrial equipment, electric automobiles and wind power generators. It is required to further improve the performance of Nd—Fe—B magnets.

Indexes for the performance of magnets include remanence (or residual magnetic flux density) and coercive force. An increase in the remanence of Nd—Fe—B sintered magnets can be achieved by increasing the volume factor of $Nd_2Fe_{14}B$ compound and improving the crystal orientation. To this end, a number of modifications have been made on the process. For increasing coercive force, there are known different approaches including grain refinement, the use of alloy compositions with greater Nd contents, and the addition of effective elements. The currently most common approach is to use alloy compositions having Dy or Tb substituted for part of Nd. Substituting these elements for Nd in the $Nd_2Fe_{14}B$ compound increases both the anisotropic magnetic field and the coercive force of the compound. The substitution with Dy or Tb, on the other hand, reduces the saturation magnetic polarization of the compound. Therefore, as long as the above approach is taken to increase coercive force, a loss of remanence is unavoidable. Since Tb and Dy are expensive metals, it is desired to minimize their addition amount.

In Nd—Fe—B magnets, the coercive force is given by the magnitude of an external magnetic field created by nuclei of reverse magnetic domains at grain boundaries. Formation of nuclei of reverse magnetic domains is largely dictated by the structure of the grain boundary in such a manner that any disorder of grain structure in proximity to the boundary invites a disturbance of magnetic structure or a decline of magneto-crystalline anisotropy, helping formation of reverse magnetic domains. It is generally believed that a magnetic structure extending from the grain boundary to a depth of about 5 nm contributes to an increase of coercive force, that is, the magneto-crystalline anisotropy is reduced in this region. It is difficult to acquire a morphology effective for increasing coercive force.

The documents pertinent to the present invention are listed below.

Patent Document 1: JP-B 5-31807

Patent Document 2: JP-A 5-21218

Non-Patent Document 1: K. D. Durst and H. Kronmuller, "THE COERCIVE FIELD OF SINTERED AND MELT-SPUN NdFeB MAGNETS," Journal of Magnetism and Magnetic Materials, 68 (1987), 63-75

Non-Patent Document 2: K. T. Park, K. Hiraga and M. Sagawa, "Effect of Metal-Coating and Consecutive Heat Treatment on Coercivity of Thin Nd—Fe—B Sintered Magnets," Proceedings of the Sixteen International Workshop on Rare-Earth Magnets and Their Applications, Sendai, p. 257 (2000)

Non-Patent Document 3: K. Machida, H. Kawasaki, S. Suzuki, M. Ito and T. Horikawa, "Grain Boundary Tailoring of Nd—Fe—B Sintered Magnets and Their Magnetic Properties," Proceedings of the 2004 Spring Meeting of the Powder & Powder Metallurgy Society, p. 202

DISCLOSURE OF THE INVENTION

Problem to be Solved by the Invention

While the invention has been made in view of the above-discussed problems, its object is to provide a method for preparing a rare earth permanent magnet material in the form of R—Fe—B sintered magnet wherein R is two or more elements selected from rare earth elements inclusive of Sc and Y, the magnet exhibiting high performance despite a minimized amount of Tb or Dy used.

Means for Solving the Problem

The inventors have discovered that when a $R^1$—Fe—B sintered magnet (wherein $R^1$ is one or more elements selected from rare earth elements inclusive of Sc and Y), typically a Nd—Fe—B sintered magnet, with a powder mixture of a powder based on at least one element selected from Al, Cu and Zn and a powder based on a fluoride of $R^2$ being disposed in a space closely surrounding the magnet surface, is heated at a temperature below the sintering temperature, M and/or $R^2$ contained in the powder mixture is effectively absorbed in the magnet body so that M and $R^2$ are concentrated only in proximity to grain boundaries for modifying the structure in proximity to the grain boundaries to restore or enhance magneto-crystalline anisotropy whereby the coercive force is increased while suppressing a decline of remanence. The invention is predicated on this discovery.

The invention provides a method for preparing a rare earth permanent magnet material, as defined below.

Claim 1:

A method for preparing a rare earth permanent magnet material, comprising the steps of:

disposing a powder mixture on a surface of a sintered magnet body of $R^1$—Fe—B composition wherein $R^1$ is at least one element selected from rare earth elements inclusive of Sc and Y, said powder mixture comprising a powder containing at least 0.5% by weight of M which is at least one element selected from Al, Cu, and Zn and having an average particle size equal to or less than 300 μm and a powder containing at least 30% by weight of a fluoride of $R^2$ which is at least one element selected from rare earth elements inclusive of Sc and Y and having an average particle size equal to or less than 100 μm, and heat treating the magnet body having the powder disposed on its surface at a temperature equal to or below the sintering temperature of the magnet body in vacuum or in an inert gas, for absorption treatment for causing at least one of M and $R^2$ in the powder mixture to be absorbed in the magnet body.

Claim 2:

A method for preparing a rare earth permanent magnet material according to claim 1, wherein the sintered magnet body to be treated with the powder mixture has a minimum portion with a dimension equal to or less than 20 mm.

Claim 3:

A method for preparing a rare earth permanent magnet material according to claim 1 or 2, wherein said powder mixture is disposed on the sintered magnet body surface in an amount corresponding to an average filling factor of at least 10% by volume in a magnet body-surrounding space at a distance equal to or less than 1 mm from the sintered magnet body surface.

Claim 4:

A method for preparing a rare earth permanent magnet material according to claim 1, 2 or 3, further comprising, after the absorption treatment with the powder mixture, effecting aging treatment on the sintered magnet body at a lower temperature.

Claim 5:

A method for preparing a rare earth permanent magnet material according to any one of claims 1 to 4, wherein the powder containing M which is at least one element selected from Al, Cu, and Zn contains a mixture of M and an oxide thereof.

Claim 6:

A method for preparing a rare earth permanent magnet material according to any one of claims 1 to 5, wherein in the fluoride of $R^2$, $R^2$ contains at least 10 atom % of at least one element selected from Nd, Pr, Dy, and Tb.

Claim 7:

A method for preparing a rare earth permanent magnet material according to any one of claims 1 to 6, wherein said powder mixture comprising a powder containing at least 0.5% by weight of M which is at least one element selected from Al, Cu, and Zn and having an average particle size equal to or less than 300 μm and a powder containing at least 30% by weight of a fluoride of $R^2$ which is at least one element selected from rare earth elements inclusive of Sc and Y and having an average particle size equal to or less than 100 μm is fed as a slurry dispersed in an aqueous or organic solvent.

Claim 8:

A method for preparing a rare earth permanent magnet material according to any one of claims 1 to 7, further comprising, prior to the step of disposing the powder mixture on the sintered magnet body, washing the sintered magnet body with at least one agent selected from alkalis, acids, and organic solvents.

Claim 9:

A method for preparing a rare earth permanent magnet material according to any one of claims 1 to 8, further comprising, prior to the step of disposing the powder mixture on the sintered magnet body, shot blasting the sintered magnet body for removing a surface layer.

Claim 10:

A method for preparing a rare earth permanent magnet material according to any one of claims 1 to 9, further comprising washing the sintered magnet body with at least one agent selected from alkalis, acids, and organic solvents after the absorption treatment with the powder mixture or after the aging treatment.

Claim 11:

A method for preparing a rare earth permanent magnet material according to any one of claims 1 to 10, further comprising machining the sintered magnet body after the absorption treatment with the powder mixture or after the aging treatment.

Claim 12:

A method for preparing a rare earth permanent magnet material according to any one of claims 1 to 11, further comprising plating or coating the sintered magnet body, after the absorption treatment with the powder mixture, after the aging treatment, after the alkali, acid or organic solvent washing step following the aging treatment, or after the machining step following the aging treatment.

BENEFITS OF THE INVENTION

According to the invention, R—Fe—B sintered magnets exhibiting high performance and having a minimized amount of Tb or Dy used are available.

BEST MODE FOR CARRYING OUT THE INVENTION

The invention pertains to an R—Fe—B sintered magnet material exhibiting high performance and having a minimized amount of Tb or Dy used.

The invention starts with an R—Fe—B sintered magnet body which is obtainable from a mother alloy by a standard procedure including crushing, fine pulverization, compaction and sintering.

As used herein, both R and $R^1$ are selected from rare earth elements inclusive of Sc and Y. R is mainly used for the finished magnet body while $R^1$ is mainly used for the starting material.

The mother alloy contains $R^1$, T, A and optionally E. $R^1$ is at least one element selected from rare earth elements inclusive of Sc and Y, specifically from among Sc, Y, La, Ce, Pr, Nd, Sm, Eu, Gd, Tb, Dy, Ho, Er, Yb, and Lu, with Nd, Pr and Dy being preferably predominant. It is preferred that rare earth elements inclusive of Sc and Y account for 10 to 15 atom %, more preferably 12 to 15 atom % of the overall alloy. Desirably $R^1$ contains at least 10 atom %, especially at least 50 atom % of Nd and/or Pr based on the entire $R^1$. T is one or both elements selected from iron (Fe) and cobalt (Co). The content of Fe is preferably at least 50 atom %, especially at least 65 atom % of the overall alloy. A is one or both elements selected from boron (B) and carbon (C). It is preferred that boron account for 2 to 15 atom %, more preferably 3 to 8 atom % of the overall alloy. E is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, and may be contained in an amount of 0 to 11 atom %, especially 0.1 to 5 atom %. The balance consists of incidental impurities such as nitrogen (N), oxygen (O) and hydrogen (H), and their total is generally equal to or less than 4 atom %.

The mother alloy is prepared by melting metal or alloy feeds in vacuum or an inert gas atmosphere, preferably argon atmosphere, and casting the melt into a flat mold or book mold or strip casting. A possible alternative is a so-called two-alloy process involving separately preparing an alloy approximate to the $R^1{}_2Fe_{14}B$ compound composition constituting the primary phase of the relevant alloy and a rare earth-rich alloy serving as a liquid phase aid at the sintering temperature, crushing, then weighing and mixing them. Notably, the alloy approximate to the primary phase composition is subjected to homogenizing treatment, if necessary, for the purpose of increasing the amount of the $R^1{}_2Fe_{14}B$ compound phase, since primary crystal α-Fe is likely to be left depending on the cooling rate during casting and the alloy composition. The homogenizing treatment is a heat treatment at 700 to 1,200° C. for at least one hour in vacuum or in an Ar atmosphere. To the rare earth-rich alloy serving as a liquid phase aid, the melt quenching and strip casting techniques are applicable as well as the above-described casting technique.

The alloy is generally crushed to a size of 0.05 to 3 mm, especially 0.05 to 1.5 mm. The crushing step uses a Brown mill or hydriding pulverization, with the hydriding pulverization being preferred for those alloys as strip cast. The coarse powder is then finely divided to a size of 0.2 to 30 μm, especially 0.5 to 20 μm, for example, by a jet mill using high-pressure nitrogen.

The fine powder is compacted on a compression molding machine under a magnetic field and then placed in a sintering furnace where it is sintered in vacuum or in an inert gas atmosphere usually at a temperature of 900 to 1,250° C., preferably 1,000 to 1,100° C. The sintered magnet thus obtained contains 60 to 99% by volume, preferably 80 to 98% by volume of the tetragonal $R^1{}_2Fe_{14}B$ compound as the primary phase, with the balance being 0.5 to 20% by volume of a rare earth-rich phase, 0 to 10% by volume of a B-rich phase, and 0.1 to 10% by volume of at least one of rare earth oxides, and carbides, nitrides and hydroxides resulting from incidental impurities, or a mixture or composite thereof.

The sintered block is then machined or worked into a predetermined shape. It is noted that M and/or $R^2$ to be absorbed in the magnet body according to the invention is fed from the magnet body surface. If the magnet body is too large in dimensions, the objects of the invention are not achievable. Then, the sintered block is preferably worked to a shape having a minimum portion with a dimension equal to or less than 20 mm, more preferably of 0.2 to 10 mm. Also preferably, the shape includes a maximum portion having a dimension of 0.1 to 200 mm, especially 0.2 to 150 mm. Any appropriate shape may be selected. For example, the block may be worked into a plate or cylindrical shape.

Then a powder mixture is disposed on a surface of the sintered magnet body, the powder mixture comprising a powder containing at least 0.5% by weight of M which is at least one element selected from Al, Cu, and Zn and having an average particle size equal to or less than 300 μm and a powder containing at least 30% by weight of a fluoride of $R^2$ which is at least one element selected from rare earth elements inclusive of Sc and Y and having an average particle size equal to or less than 100 μm. The magnet body with the powder mixture on its surface is heat treated at a temperature equal to or below the sintering temperature in vacuum or in an inert gas such as Ar or He. This heat treatment causes M and/or $R^2$ to be absorbed in the magnet body. If M is present alone on the magnet surface, it is not effectively absorbed in the magnet body. The presence of M in admixture with $R^2$ fluoride ensures effective absorption. M is absorbed in the magnet body mainly through the grain boundary phase while it modifies the interfacial structure of $R^1{}_2Fe_{14}B$ grains, resulting in an increased coercive force. M is selected from Al, Cu and Zn to exert this effect to a full extent; and a powder of such a single element, an alloy powder, a mixed powder or alloy powder thereof with Mn, Fe, Co, Ni, Si, Ti, Ag, Ga, B or the like may be used. In this regard, the content of M in the powder is at least 0.5% by weight, preferably at least 1% by weight, more preferably at least 2% by weight, while the M content is not particularly restricted in upper limit and may be 100% by weight, specifically up to 95% by weight, and more specifically up to 90% by weight.

Also the benefits of the invention are achievable with a powder in which at least 10% by area of surfaces of M-based particles are covered with at least one of oxide, carbide, nitride and hydride. In this case, the powder may contain a mixture of M and an oxide thereof, and the benefits of the invention are achievable even when an oxide of M is included. The content of M is as defined above while the content of M oxide is 0.1 to 50% by weight based on the weight of M.

For the reason that the smaller the particle size of the powder, the higher becomes the absorption efficiency, the powder preferably has an average particle size equal to or less than 500 μm, more preferably equal to or less than 300 μm, and even more preferably equal to or less than 100 μm. The lower limit of particle size is preferably equal to or more than 1 nm, more preferably equal to or more than 10 nm though not particularly restrictive. It is noted that the average particle size is determined as a weight average diameter $D_{50}$ (particle diameter at 50% by weight cumulative, or median diameter) using, for example, a particle size distribution measuring instrument relying on laser diffractometry or the like.

Since $R^2$ being absorbed at the same time gives rise to substitution reaction with $R^1{}_2Fe_{14}B$ grains in proximity to grain boundaries, $R^2$ is preferably such a rare earth element that it does not reduce the magneto-crystalline anisotropy of $R^1{}_2Fe_{14}B$ grains. While $R^2$ is selected from rare earth elements inclusive of Sc and Y, it is desired that at least one of Pr, Nd, Tb and Dy be predominant of $R^2$. It is preferred that $R^2$ contain at least 10 atom %, more preferably at least 20 atom %, and even more preferably at least 40 atom % of at least one of Pr, Nd, Tb and Dy, and even 100 atom %. Further, the fluoride of $R^2$ disposed on the magnet surface is preferably $R^2F_3$, but generally refers to fluorides containing $R^2$ and fluorine, including $R^2O_mF_n$ wherein m and n are arbitrary positive numbers, and modified forms thereof in which part of $R^2$ is substituted or stabilized with another metal element as long as they can achieve the benefits of the invention.

The powder containing $R^2$ fluoride may contain at least 30% by weight, preferably at least 50% by weight, and more preferably at least 70% by weight of $R^2$ fluoride, and even 100% by weight. Particulate materials other than $R^2$ fluoride contained in the powder include those of oxides, hydroxides, and borides of rare earth elements inclusive of Sc and Y.

The powder containing $R^2$ fluoride has an average particle size equal to or less than 100 μm, preferably equal to or less than 50 μm, more preferably equal to or less than 20 μm, even more preferably equal to or less than 10 μm. The average particle size is not particularly restricted in lower limit and is preferably at least 1 nm, and more preferably at least 10 nm.

In the powder mixture of the powder containing M (P-1) and the powder containing $R^2$ fluoride (P-2), the mixing proportion of powder (P-1) and powder (P-2) is preferably from 1:99 to 90:10, more preferably from 1:99 to 40:60 in a weight ratio of (P-1)/(P-2).

For the reason that a more amount of M and R is absorbed as the filling factor of the powder mixture in the magnet surface-surrounding space is higher, the filling factor is at least 10% by volume, preferably at least 40% by volume, calculated as an average value in the magnet surrounding space from the magnet surface to a distance equal to or less than 1 mm, in order for the invention to attain its effect. The upper limit of filling factor is generally equal to or less than 95% by volume, and especially equal to or less than 90% by volume, though not particularly restrictive.

One exemplary technique of disposing or applying the powder mixture is by dispersing the powder mixture in water or an organic solvent to form a slurry, immersing the magnet body in the slurry, and drying in hot air or in vacuum or drying in the ambient air. Alternatively, the powder mixture can be applied by spray coating or the like. Any such technique is characterized by ease of application and mass treatment. Specifically the slurry may contain the powder mixture in a concentration of 1 to 90% by weight, more specifically 5 to 70% by weight.

After the powder mixture is disposed on the magnet body surface as described above, the magnet body and the powder are heat treated at a temperature equal to or below the sintering temperature in vacuum or in an inert gas atmosphere such as Ar or He. The temperature of heat treatment is equal to or below the sintering temperature (designated Ts in ° C.) of the magnet body, preferably equal to or below (Ts-10)° C., and more preferably equal to or below (Ts-20)° C. The lower limit of temperature is preferably at least 210° C., more preferably at least 360° C. The time of heat treatment, which varies with the heat treatment temperature, is preferably from 1 minute to 100 hours, more preferably from 5 minutes to 50 hours, and even more preferably from 10 minutes to 20 hours.

After the absorption treatment is effected as described above, the resulting sintered magnet body is preferably subjected to aging treatment. The aging treatment is desirably at a temperature which is below the absorption treatment temperature, preferably from 200° C. to a temperature lower than the absorption treatment temperature by 10° C., and more preferably from 350° C. to a temperature lower than the absorption treatment temperature by 10° C. The atmosphere is preferably vacuum or an inert gas such as Ar or He. The time of aging treatment is from 1 minute to 10 hours, preferably from 10 minutes to 5 hours, and more preferably from 30 minutes to 2 hours.

It is noted for the machining or working of the sintered magnet body that if an aqueous coolant is used in the machining tool, or if the surface being machined is exposed to high temperature during the working, there is a likelihood of an oxide film forming on the machined surface, which oxide film can inhibit the absorption reaction from the powder deposit to the magnet body. In such a case, the oxide film is removed by washing with at least one of alkalis, acids and organic solvents or by shot blasting before adequate absorption treatment is carried out. That is, the sintered magnet body worked to the predetermined shape is washed with at least one agent of alkalis, acids and organic solvents or shot blasted for removing a surface affected layer therefrom before the absorption treatment is carried out.

Also, after the absorption treatment or after the aging treatment, the sintered magnet body may be washed with at least one agent selected from alkalis, acids and organic solvents, or machined again. Alternatively, plating or paint coating may be carried out after the absorption treatment, after the aging treatment, after the washing step, or after the machining step.

Suitable alkalis which can be used herein include potassium pyrophosphate, sodium pyrophosphate, potassium citrate, sodium citrate, potassium acetate, sodium acetate, potassium oxalate, sodium oxalate, etc.; suitable acids include hydrochloric acid, nitric acid, sulfuric acid, acetic acid, citric acid, tartaric acid, etc.; and suitable organic solvents include acetone, methanol, ethanol, isopropyl alcohol, etc. In the washing step, the alkali or acid may be used as an aqueous solution with a suitable concentration not attacking the magnet body.

The above-described washing, shot blasting, machining, plating, and coating steps may be carried out by standard techniques.

The permanent magnet material thus obtained can be used as high-performance permanent magnets.

EXAMPLE

Examples and Comparative Examples are given below for further illustrating the invention although the invention is not limited thereto. In Examples, the filling factor (or percent occupancy) of the magnet surface-surrounding space with powder like neodymium fluoride is calculated from a dimensional change and weight gain of the magnet after powder treatment and the true density of powder material.

Example 1

An alloy in thin plate form was prepared by a strip casting technique, specifically by using Nd, Al, Fe and Cu metals having a purity of at least 99% by weight and ferroboron, high-frequency heating in an argon atmosphere for melting, and casting the alloy melt on a copper single roll. The resulting alloy consisted of 14.0 atom % Nd, 0.5 atom % Al, 0.3 atom % Cu, 5.8 atom % B, and the balance of Fe. The alloy was exposed to 0.11 MPa of hydrogen gas at room temperature for hydriding and then heated at 500° C. for partial dehydriding while evacuating to vacuum. The hydriding pulverization was followed by cooling and sieving, obtaining a coarse powder under 50 mesh.

On a jet mill using high-pressure nitrogen gas, the coarse powder was finely pulverized to a mass median particle diameter of 4.7 μm. The resulting fine powder was compacted in a nitrogen atmosphere under a pressure of about 1 ton/cm$^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 50 mm×20 mm×2 mm (thick). It was successively washed with alkaline solution, deionized water, nitric acid, and deionized water, and dried.

Subsequently, (100−x) g of aluminum flake powder and x g of neodymium fluoride (wherein x=0, 25, 50, 75, 100) were mixed with 100 g of ethanol to form a suspension, in which the magnet body was immersed for 60 seconds with ultrasonic waves being applied. It is noted that the aluminum flake powder had an average thickness of 3.5 μm and an average diameter of 36 μm, and the neodymium fluoride powder had an average particle size of 2.4 μm. The magnet body was pulled up and immediately dried with hot air. At this point, the powder mixture surrounded the magnet and occupied a space spaced from the magnet surface at an average distance of 13 μm at a filling factor of 40-45% by volume.

The magnet body covered with aluminum flake powder and neodymium fluoride powder was subjected to absorption treatment in an argon atmosphere at 800° C. for 8 hours, then to aging treatment at 500° C. for one hour, and quenched, obtaining magnet bodies within the scope of the invention. Those magnet bodies with x=0 and 100 are comparative examples. Those magnet bodies with x=25, 50, and 75 are designated M1-1, M1-2, and M1-3, respectively, and those magnet bodies with x=0 and 100 are designated P1-1 and P1-2, respectively. Further, a magnet body was prepared by subjecting the magnet body to only heat treatment without powder coverage. It is designated P1-3.

Magnetic properties of magnet bodies M1-1 to 3 and P1-1 to 3 are shown in Table 1. Magnet body P1-1 with only aluminum flake powder and magnet body P1-2 with only neodymium fluoride showed coercive force values approximate to that of magnet body P1-3 subject to only heat treatment. By contrast, magnet bodies M1-1 to 3 within the scope of the invention showed a coercive force increase of 84 kAm$^{-1}$ or more. A drop of remanence was 11 mT or less.

TABLE 1

| | | $B_r$ (T) | $H_{cJ}$ (kAm$^{-1}$) | $(BH)_{max}$ (kJ/m$^3$) |
|---|---|---|---|---|
| Example | M1-1 | 1.420 | 1082 | 390 |
| | M1-2 | 1.424 | 1090 | 392 |
| | M1-3 | 1.424 | 1003 | 394 |
| Comparative Example | P1-1 | 1.422 | 922 | 390 |
| | P1-2 | 1.426 | 918 | 393 |
| | P1-3 | 1.431 | 919 | 397 |

Example 2

An alloy in thin plate form was prepared by a strip casting technique, specifically by using Nd, Al and Fe metals having a purity of at least 99% by weight and ferroboron, high-frequency heating in an argon atmosphere for melting, and casting the alloy melt on a copper single roll. The resulting alloy consisted of 13.5 atom % Nd, 0.5 atom % Al, 6.0 atom % B, and the balance of Fe. The alloy was exposed to 0.11 MPa of hydrogen gas at room temperature for hydriding and then heated at 500° C. for partial dehydriding while evacuating to vacuum. The hydriding pulverization was followed by cooling and sieving, obtaining a coarse powder under 50 mesh (Alloy Powder A).

Separately, an ingot was prepared by using Nd, Dy, Fe, Co, Al and Cu metals having a purity of at least 99% by weight and ferroboron, high-frequency heating in an argon atmosphere for melting, and casting the alloy melt into a flat mold. The ingot had a composition of 20 atom % Nd, 10 atom % Dy, 24 atom % Fe, 6 atom % B, 1 atom % Al, 2 atom % Cu, and the balance of Co. The alloy was ground on a jaw crusher and a Brown mill in a nitrogen atmosphere and sieved, obtaining a coarse powder under 50 mesh (Alloy Powder B).

The two alloy powders were weighed in a weight ratio A:B of 90:10 and mixed together on a V blender for 30 minutes. On a jet mill using high-pressure nitrogen gas, the mixed powder was pulverized into a fine powder having a mass median particle diameter of 4.7 μm. The resulting mixed fine powder was compacted in a nitrogen atmosphere under a pressure of about 1 ton/cm$^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 40 mm×12 mm×4 mm (thick). It was successively washed with alkaline solution, deionized water, nitric acid, and deionized water, and dried.

Subsequently, x g of aluminum flake powder and (100−x) g of terbium fluoride (wherein x=0, 0.5, 1, 1.5, 2) were mixed with 100 g of ethanol to form a suspension, in which the magnet body was immersed for 60 seconds with ultrasonic waves being applied. It is noted that the aluminum flake powder had an average thickness of 3.5 μm and an average diameter of 36 μm, and the terbium fluoride powder had an average particle size of 1.6 μm. The magnet body was pulled up and immediately dried with hot air. At this point, the powder mixture surrounded the magnet and occupied a space spaced from the magnet surface at an average distance of 15 μm at a filling factor of 40-50% by volume.

The magnet body covered with aluminum flake powder and terbium fluoride powder was subjected to absorption treatment in an argon atmosphere at 800° C. for 20 hours, then to aging treatment at 510° C. for one hour, and quenched, obtaining magnet bodies. The magnet body with x=0 is a comparative example. Those magnet bodies with x=0.5, 1, 1.5, and 2 are designated M2-1, M2-2, M2-3, and M2-4, respectively, and the magnet bodies with x=0 is designated P2-1. Further, a magnet body was prepared by subjecting the magnet body to only heat treatment without powder coverage. It is designated P2-2.

Magnetic properties of magnet bodies M2-1 to 4 and P2-1 to 2 are shown in Table 2. As compared with magnet body P2-2, magnet body P2-1 with only terbium fluoride showed a coercive force higher by 390 kAm$^{-1}$, and magnet bodies M2-1 to 4 within the scope of the invention showed a coercive force increase of 443 kAm$^{-1}$ or more. A drop of remanence was 12 mT or less.

TABLE 2

| | | $B_r$ (T) | $H_{cJ}$ (kAm$^{-1}$) | $(BH)_{max}$ (kJ/m$^3$) |
|---|---|---|---|---|
| Example | M2-1 | 1.405 | 1528 | 382 |
| | M2-2 | 1.403 | 1576 | 380 |
| | M2-3 | 1.403 | 1544 | 381 |
| | M2-4 | 1.401 | 1501 | 380 |
| Comparative Example | P2-1 | 1.405 | 1448 | 382 |
| | P2-2 | 1.402 | 1058 | 380 |

Example 3

An alloy in thin plate form was prepared by a strip casting technique, specifically by using Nd, Pr, Al and Fe metals having a purity of at least 99% by weight and ferroboron, high-frequency heating in an argon atmosphere for melting, and casting the alloy melt on a copper single roll. The resulting alloy consisted of 12.5 atom % Nd, 1.5 atom % Pr, 0.5 atom % Al, 5.8 atom % B, and the balance of Fe. The alloy was exposed to 0.11 MPa of hydrogen gas at room temperature for hydriding and then heated at 500° C. for partial dehydriding while evacuating to vacuum. The hydriding pulverization was followed by cooling and sieving, obtaining a coarse powder under 50 mesh.

On a jet mill using high-pressure nitrogen gas, the coarse powder was finely pulverized to a mass median particle diameter of 4.4 μm. The resulting fine powder was compacted in a nitrogen atmosphere under a pressure of about 1 ton/cm$^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 50 mm×50 mm×8 mm (thick). It was successively washed with alkaline solution, deionized water, nitric acid, and deionized water, and dried.

Subsequently, (100−x) g of copper powder and x g of dysprosium fluoride (wherein x=0, 25, 50, 75, 100) were mixed with 100 g of deionized water to form a suspension, in which the magnet body was immersed for 60 seconds with ultrasonic waves being applied. It is noted that the copper powder had an average particle size of 15 μm, and the dysprosium fluoride powder had an average particle size of 1.6 μm. The magnet body was pulled up and immediately dried with hot air. At this point, the powder mixture surrounded the magnet and occupied a space spaced from the magnet surface at an average distance of 42 μm at a filling factor of 45-55% by volume.

The magnet body covered with copper powder and dysprosium fluoride powder was subjected to absorption treatment in an argon atmosphere at 850° C. for 12 hours, then to aging treatment at 535° C. for one hour, and quenched, obtaining magnet bodies. Those magnet bodies with x=0 and 100 are comparative examples. Those magnet bodies with x=25, 50, and 75 are designated M3-1, M3-2, and M3-3, respectively, and those magnet bodies with x=0 and 100 are designated P3-1 and P3-2, respectively. Further, a magnet body was prepared by subjecting the magnet body to only heat treatment without powder coverage. It is designated P3-3.

Magnetic properties of magnet bodies M3-1 to 3 and P3-1 to 3 are shown in Table 3. Magnet body P3-1 with only copper powder showed a coercive force substantially equal to that of magnet body P3-3 subject to only heat treatment. Magnet body P3-2 with only dysprosium fluoride powder showed a higher coercive force by 175 kAm$^{-1}$ than P3-3. By contrast, magnet bodies M3-1 to 3 within the scope of the invention showed a coercive force increase of 247 $kAm^{-1}$ or more. A drop of remanence was 18 mT or less.

TABLE 3

| | | $B_r$ (T) | $H_{cJ}$ ($kAm^{-1}$) | $(BH)_{max}$ ($kJ/m^3$) |
|---|---|---|---|---|
| Example | M3-1 | 1.412 | 1225 | 386 |
| | M3-2 | 1.411 | 1249 | 385 |
| | M3-3 | 1.407 | 1218 | 382 |
| Comparative Example | P3-1 | 1.418 | 947 | 390 |
| | P3-2 | 1.406 | 1146 | 381 |
| | P3-3 | 1.425 | 971 | 394 |

Example 4

An alloy in thin plate form was prepared by a strip casting technique, specifically by using Nd, Al and Fe metals having a purity of at least 99% by weight and ferroboron, high-frequency heating in an argon atmosphere for melting, and casting the alloy melt on a copper single roll. The resulting alloy consisted of 13.5 atom % Nd, 0.5 atom % Al, 6.0 atom % B, and the balance of Fe. The alloy was exposed to 0.11 MPa of hydrogen gas at room temperature for hydriding and then heated at 500° C. for partial dehydriding while evacuating to vacuum. The hydriding pulverization was followed by cooling and sieving, obtaining a coarse powder under 50 mesh (designated alloy powder C).

Separately, an ingot was prepared by using Nd, Dy, Fe, Co, Al and Cu metals having a purity of at least 99% by weight and ferroboron, high-frequency heating in an argon atmosphere for melting, and casting in a flat mold. The ingot consisted of 20 atom % Nd, 10 atom % Dy, 24 atom % Fe, 6 atom % B, 1 atom % Al, 2 atom % Cu, and the balance of Co. The alloy was crushed on a jaw crusher and a Brown mill in a nitrogen atmosphere and sieved, obtaining a coarse powder under 50 mesh (designated alloy powder D).

The two alloy powders were weighed in a weight ratio C:D of 90:10, and mixed together on a V blender for 30 minutes. On a jet mill using high-pressure nitrogen gas, the mixed powder was pulverized into a fine powder having a mass median particle diameter of 4.7 μm. The resulting mixed fine powder was compacted in a nitrogen atmosphere under a pressure of about 1 $ton/cm^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 40 mm×12 mm×4 mm (thick). It was successively washed with alkaline solution, deionized water, nitric acid, and deionized water, and dried.

Subsequently, (50−x) g of aluminum flake powder, x g of copper powder, and 50 g of neodymium fluoride (wherein x=0, 25, 50) were mixed with 100 g of ethanol to form a suspension, in which the magnet body was immersed for 60 seconds with ultrasonic waves being applied. It is noted that the aluminum flake powder had an average thickness of 3.5 μm and an average diameter of 36 μm, the copper powder had an average particle size of 15 μm, and the neodymium fluoride powder had an average particle size of 2.4 μm. The magnet body was pulled up and immediately dried with hot air. At this point, the powder mixture surrounded the magnet and occupied a space spaced from the magnet surface at an average distance of 62 μm at a filling factor of 30-40% by volume.

The magnet body covered with aluminum flake powder, copper powder and neodymium fluoride powder was subjected to absorption treatment in an argon atmosphere at 800° C. for 10 hours, then to aging treatment at 500° C. for one hour, and quenched, obtaining magnet bodies. Those magnet bodies with x=0, 25, and 50 are designated M4-1, M4-2, and M4-3, respectively. Further, a magnet body was prepared by subjecting the magnet body to only heat treatment without powder coverage. It is designated P4-1.

Magnetic properties of magnet bodies M4-1 to 3 and P4-1 are shown in Table 4. As compared with magnet body P4-1 subject to only heat treatment, magnet bodies M4-1 to 3 within the scope of the invention showed a coercive force increase of 152 $kAm^{-1}$ or more. A drop of remanence was 12 mT or less.

TABLE 4

| | | $B_r$ (T) | $H_{cJ}$ ($kAm^{-1}$) | $(BH)_{max}$ ($kJ/m^3$) |
|---|---|---|---|---|
| Example | M4-1 | 1.403 | 1202 | 381 |
| | M4-2 | 1.404 | 1218 | 381 |
| | M4-3 | 1.405 | 1210 | 382 |
| Comparative Example | P4-1 | 1.415 | 1050 | 388 |

Example 5

An alloy in thin plate form was prepared by a strip casting technique, specifically by using Nd, Al, Fe and Cu metals having a purity of at least 99% by weight and ferroboron, high-frequency heating in an argon atmosphere for melting, and casting the alloy melt on a copper single roll. The resulting alloy consisted of 14.0 atom % Nd, 0.5 atom % Al, 0.3 atom % Cu, 5.8 atom % B, and the balance of Fe. The alloy was exposed to 0.11 MPa of hydrogen gas at room temperature for hydriding and then heated at 500° C. for partial dehydriding while evacuating to vacuum. The hydriding pulverization was followed by cooling and sieving, obtaining a coarse powder under 50 mesh.

On a jet mill using high-pressure nitrogen gas, the coarse powder was finely pulverized to a mass median particle diameter of 4.7 μm. The resulting fine powder was compacted in a nitrogen atmosphere under a pressure of about 1 $ton/cm^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 50 mm×20 mm×4 mm (thick). It was successively washed with alkaline solution, deionized water, nitric acid, and deionized water, and dried.

Subsequently, (100−x) g of zinc powder and x g of dysprosium fluoride (wherein x=0, 25, 50, 75, 100) were mixed with 100 g of ethanol to form a suspension, in which the magnet body was immersed for 60 seconds with ultrasonic waves being applied. It is noted that the zinc powder had an average particle size of 20 μm, and the dysprosium fluoride powder had an average particle size of 1.6 μm. The magnet body was pulled up and immediately dried with hot air. At this point, the powder mixture surrounded the magnet and occupied a space spaced from the magnet surface at an average distance of 32 μm at a filling factor of 40-45% by volume.

The magnet body covered with zinc powder and dysprosium fluoride powder was subjected to absorption treatment in an argon atmosphere at 850° C. for 10 hours, then to aging treatment at 520° C. for one hour, and quenched, obtaining magnet bodies within the scope of the invention. Those magnet bodies with x=0 and 100 are comparative examples. Those magnet bodies with x=25, 50, and 75 are designated M5-1, M5-2, and M5-3, respectively, and those magnet bodies with x=0 and 100 are designated P5-1 and P5-2, respectively. Further, a magnet body was prepared by subjecting the magnet body to only heat treatment without powder coverage. It is designated P5-3.

Magnetic properties of magnet bodies M5-1 to 3 and P5-1 to 3 are shown in Table 5. Magnet body P5-1 with only zinc powder showed a coercive force substantially equal to that of magnet body P5-3 subject to only heat treatment. Magnet body P5-2 with only dysprosium fluoride powder showed a higher coercive force by 378 $kAm^{-1}$ than P5-3. By contrast, magnet bodies M5-1 to 3 within the scope of the invention showed a coercive force increase of 474 $kAm^{-1}$ or more. A drop of remanence was 23 mT.

TABLE 5

| | | $B_r$ (T) | $H_{cJ}$ ($kAm^{-1}$) | $(BH)_{max}$ ($kJ/m^3$) |
|---|---|---|---|---|
| Example | M5-1 | 1.408 | 1472 | 383 |
| | M5-2 | 1.415 | 1401 | 388 |
| | M5-3 | 1.422 | 1393 | 392 |
| Comparative Example | P5-1 | 1.402 | 891 | 380 |
| | P5-2 | 1.426 | 1297 | 394 |
| | P5-3 | 1.431 | 919 | 397 |

Example 6

An alloy in thin plate form was prepared by a strip casting technique, specifically by using Nd, Pr, Al, Fe, Cu, Si, Ti, V, Cr, Mn, Ni, Ga, Ge, Zr, Nb, Mo, Hf, Ta and W metals having a purity of at least 99% by weight and ferroboron, high-frequency heating in an argon atmosphere for melting, and casting the alloy melt on a copper single roll. The resulting alloy consisted of 11.5 atom % Nd, 2.0 atom % Pr, 0.5 atom % Al, 0.3 atom % Cu, 0.5 atom % E (=Cu, Si, Ti, V, Cr. Mn, Ni, Ga, Ge, Zr, Nb, Mo, Hf, Ta or W), 5.8 atom % B, and the balance of Fe. The alloy was exposed to 0.11 MPa of hydrogen gas at room temperature for hydriding and then heated at 500° C. for partial dehydriding while evacuating to vacuum. The hydriding pulverization was followed by cooling and sieving, obtaining a coarse powder under 50 mesh.

On a jet mill using high-pressure nitrogen gas, the coarse powder was finely pulverized to a mass median particle diameter of 4.7 μm. The resulting fine powder was compacted in a nitrogen atmosphere under a pressure of about 1 ton/$cm^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 5 mm×5 mm×2.5 mm (thick). It was successively washed with alkaline solution, deionized water, citric acid, and deionized water, and dried.

Subsequently, 70 g of aluminum flake powder and 30 g of neodymium fluoride were mixed with 100 g of ethanol to form a suspension, in which the magnet body was immersed for 60 seconds with ultrasonic waves being applied. It is noted that the aluminum flake powder had an average thickness of 3.5 μm and an average diameter of 36 μm, and the neodymium fluoride powder had an average particle size of 2.4 μm. The magnet body was pulled up and immediately dried with hot air. At this point, the powder mixture surrounded the magnet and occupied a space spaced from the magnet surface at an average distance of 35 μm at a filling factor of 35-45% by volume.

The magnet body covered with aluminum flake powder and neodymium fluoride powder was subjected to absorption treatment in an argon atmosphere at 800° C. for 8 hours, then to aging treatment at 470° C. to 520° C. for one hour, and quenched, obtaining magnet bodies within the scope of the invention. Those magnet bodies wherein additive element E=Cu, Si, Ti, V, Cr, Mn, Ni, Ga, Ge, Zr, Nb, Mo, Hf, Ta and W are designated M6-1 to 15 in sequence. For comparison purposes, magnet bodies were prepared by subjecting the magnet body to only heat treatment. They are likewise designated P6-1 to 15.

Magnetic properties of magnet bodies M6-1 to 15 and P6-1 to 15 are shown in Table 6. Magnet bodies M6-1 to 15 within the scope of the invention showed a coercive force increase of 47 $kAm^{-1}$ or more over magnet bodies P6-1 to 15 subject to only heat treatment, when comparison was made between those having the same additive element. A drop of remanence was 29 mT or less.

TABLE 6

| | | $B_r$ (T) | $H_{cJ}$ ($kAm^{-1}$) | $(BH)_{max}$ ($kJ/m^3$) |
|---|---|---|---|---|
| Example | M6-1 | 1.400 | 1082 | 379 |
| | M6-2 | 1.388 | 1019 | 373 |
| | M6-3 | 1.390 | 1027 | 373 |
| | M6-4 | 1.389 | 1050 | 373 |
| | M6-5 | 1.382 | 1066 | 369 |
| | M6-6 | 1.380 | 1003 | 369 |
| | M6-7 | 1.378 | 995 | 368 |
| | M6-8 | 1.398 | 1178 | 378 |
| | M6-9 | 1.400 | 1090 | 379 |
| | M6-10 | 1.387 | 1050 | 372 |
| | M6-11 | 1.372 | 1027 | 365 |
| | M6-12 | 1.382 | 1042 | 369 |
| | M6-13 | 1.372 | 1035 | 364 |
| | M6-14 | 1.378 | 1003 | 367 |
| | M6-15 | 1.384 | 987 | 370 |
| Comparative Example | P6-1 | 1.405 | 1003 | 383 |
| | P6-2 | 1.398 | 947 | 379 |
| | P6-3 | 1.396 | 971 | 378 |
| | P6-4 | 1.401 | 995 | 380 |
| | P6-5 | 1.389 | 1019 | 374 |
| | P6-6 | 1.390 | 931 | 375 |
| | P6-7 | 1.385 | 931 | 372 |
| | P6-8 | 1.403 | 1066 | 381 |
| | P6-9 | 1.407 | 995 | 384 |
| | P6-10 | 1.399 | 971 | 380 |
| | P6-11 | 1.395 | 955 | 377 |
| | P6-12 | 1.395 | 979 | 377 |
| | P6-13 | 1.401 | 971 | 381 |
| | P6-14 | 1.388 | 939 | 373 |
| | P6-15 | 1.391 | 923 | 375 |

Example 7

A sintered block was prepared in accordance with the same composition and procedure as in Example 2. Using a diamond cutter, the magnet block was machined on all the surfaces to dimensions of 40 mm×12 mm×4 mm (thick). It was successively washed with alkaline solution, deionized water, nitric acid, and deionized water, and dried.

Subsequently, 1 g of aluminum flake powder and 99 g of terbium fluoride were mixed with 100 g of ethanol to form a suspension, in which the magnet body was immersed for 60 seconds with ultrasonic waves being applied. It is noted that the aluminum flake powder had an average thickness of 3.5 μm and an average diameter of 36 μm, and the terbium fluoride powder had an average particle size of 1.6 μm. The magnet body was pulled up and immediately dried with hot air. At this point, the powder mixture surrounded the magnet and occupied a space spaced from the magnet surface at a distance of 8 μm at a filling factor of 45% by volume.

The magnet body covered with aluminum flake powder and terbium fluoride powder was subjected to absorption treatment in an argon atmosphere at 800° C. for 20 hours, then to aging treatment at 510° C. for one hour, and quenched. The magnet body was washed with an alkaline solution, then with acid, and dried. Before and after each washing step, the step of washing with deionized water was included. This magnet body within the scope of the invention is designated M7.

Magnetic properties of magnet body M7 are shown in Table 7. It is evident that as compared with magnet body M2 which was not washed after the absorption treatment, the magnet body which was subjected to the washing step after the absorption treatment exhibited high magnetic properties.

TABLE 7

| | | $B_r$ (T) | $H_{cJ}$ ($kAm^{-1}$) | $(BH)_{max}$ ($kJ/m^3$) |
|---|---|---|---|---|
| Example | M7 | 1.403 | 1576 | 380 |

Examples 8 and 9

A sintered block was prepared in accordance with the same composition and procedure as in Example 2. Using a diamond cutter, the magnet block was machined on all the surfaces to dimensions of 40 mm×12 mm×4 mm (thick). It was successively washed with alkaline solution, deionized water, nitric acid, and deionized water, and dried.

Subsequently, 1 g of aluminum flake powder and 99 g of terbium fluoride were mixed with 100 g of ethanol to form a suspension, in which the magnet body was immersed for 60 seconds with ultrasonic waves being applied. It is noted that the aluminum flake powder had an average thickness of 3.5 μm and an average diameter of 36 μl, and the terbium fluoride powder had an average particle size of 1.6 μm. The magnet body was pulled up and immediately dried with hot air. At this point, the powder mixture surrounded the magnet and occupied a space spaced from the magnet surface at a distance of 9 μm at a filling factor of 45% by volume.

The magnet body covered with aluminum flake powder and terbium fluoride powder was subjected to absorption treatment in an argon atmosphere at 800° C. for 20 hours, then to aging treatment at 510° C. for one hour, and quenched. Using an outer blade cutter, the magnet body was machined to dimensions of 10 mm×5 mm×4 mm (thick). This magnet body within the scope of the invention is designated M8. The magnet body was further subjected to electric copper/nickel plating, obtaining a magnet body M9 within the scope of the invention.

Magnetic properties of magnet bodies M8 and M9 are shown in Table 8. It is evident that the magnet bodies which were subjected to machining and plating after the absorption treatment showed equivalent magnetic properties to magnet body M2 without such processing.

TABLE 8

| | | $B_r$ (T) | $H_{cJ}$ ($kAm^{-1}$) | $(BH)_{max}$ ($kJ/m^3$) |
|---|---|---|---|---|
| Example | M8 | 1.400 | 1573 | 379 |
| | M9 | 1.401 | 1574 | 378 |

The invention claimed is:

1. A method for preparing a rare earth permanent magnet material, comprising the steps of:

disposing a powder mixture on a surface of a sintered magnet body of $R^1$—Fe—B composition wherein $R^1$ is at least one element selected from rare earth elements inclusive of Sc and Y, said powder mixture comprising a powder containing at least 0.5% by weight of M which is at least one element selected from Al, Cu, and Zn and having an average particle size equal to or less than 300 and a powder containing at least 30% by weight of a fluoride of $R^2$ which is at least one element selected from rare earth elements inclusive of Sc and Y and having an average particle size equal to or less than 100 μm, and heat treating the magnet body having the powder disposed on its surface at a temperature equal to or below the sintering temperature of the magnet body in vacuum or in an inert gas, for absorption treatment for causing at least one of M and $R^2$ in the powder mixture to be absorbed in the magnet body.

2. A method for preparing a rare earth permanent magnet material according to claim 1, wherein the sintered magnet body to be treated with the powder mixture has a minimum portion with a dimension equal to or less than 20 mm.

3. A method for preparing a rare earth permanent magnet material according to claim 1, wherein said powder mixture is disposed on the sintered magnet body surface in an amount corresponding to an average filling factor of at least 10% by volume in a magnet body-surrounding space at a distance equal to or less than 1 mm from the sintered magnet body surface.

4. A method for preparing a rare earth permanent magnet material according to claim 1, further comprising, after the absorption treatment with the powder mixture, effecting aging treatment on the sintered magnet body at a lower temperature.

5. A method for preparing a rare earth permanent magnet material according to claim 1, wherein the powder containing M which is at least one element selected from Al, Cu, and Zn contains a mixture of M and an oxide thereof.

6. A method for preparing a rare earth permanent magnet material according to claim 1, wherein in the fluoride of $R^2$, $R^2$ contains at least 10 atom % of at least one element selected from Nd, Pr, Dy, and Tb.

7. A method for preparing a rare earth permanent magnet material according to claim 1, wherein said powder mixture comprising a powder containing at least 0.5% by weight of M which is at least one element selected from Al, Cu, and Zn and having an average particle size equal to or less than 300 μm and a powder containing at least 30% by weight of a fluoride of $R^2$ which is at least one element selected from rare earth elements inclusive of Sc and Y and having an average particle size equal to or less than 100 μm is fed as a slurry dispersed in an aqueous or organic solvent.

8. A method for preparing a rare earth permanent magnet material according to claim 1, further comprising, prior to the step of disposing the powder mixture on the sintered magnet body, washing the sintered magnet body with at least one agent selected from alkalis, acids, and organic solvents.

9. A method for preparing a rare earth permanent magnet material according to claim 1, further comprising, prior to the step of disposing the powder mixture on the sintered magnet body, shot blasting the sintered magnet body for removing a surface layer.

10. A method for preparing a rare earth permanent magnet material according to claim 1, further comprising washing the sintered magnet body with at least one agent selected from alkalis, acids, and organic solvents after the absorption treatment with the powder mixture or after the aging treatment.

11. A method for preparing a rare earth permanent magnet material according to claim 1, further comprising machining the sintered magnet body after the absorption treatment with the powder mixture or after the aging treatment.

12. A method for preparing a rare earth permanent magnet material according to claim 1, further comprising plating or coating the sintered magnet body, after the absorption treatment with the powder mixture, after the aging treatment, after the alkali, acid or organic solvent washing step following the aging treatment, or after the machining step following the aging treatment.

* * * * *